United States Patent [19]

Rave

[11] 4,154,647

[45] * May 15, 1979

[54] PREPARATION OF HYDROPHILIC POLYOLEFIN FIBERS FOR USE IN PAPERMAKING

[75] Inventor: Terence W. Rave, Wilmington, Del.

[73] Assignee: Hercules Incorporated, Wilmington, Del.

[ * ] Notice: The portion of the term of this patent subsequent to Jul. 12, 1994, has been disclaimed.

[21] Appl. No.: 819,425

[22] Filed: Jul. 27, 1977

[51] Int. Cl.[2] ..... D21H 5/12

[52] U.S. Cl. ..... 162/157 R; 162/146; 162/164 R; 162/164 EP; 162/168 R; 162/168 N; 162/168 NA; 162/182; 427/221; 427/444; 428/394; 428/395

[58] Field of Search ..... 260/29.2 EP, 29.2 N, 260/29.6 H, 29.6 NR; 162/146, 157 R, 166, 167, 168 N, 168 NA, 168 R, 182, 164 R, 164 EP; 427/444, 221; 428/394, 395

[56] References Cited

U.S. PATENT DOCUMENTS

| | | | |
|---|---|---|---|
| 3,288,770 | 11/1966 | Butler | 260/88.3 |
| 3,403,113 | 9/1968 | Diethelm et al. | 260/2 |
| 3,556,932 | 1/1971 | Coscia et al. | 162/166 |
| 3,677,888 | 7/1972 | Economou | 162/168 NA |
| 3,686,109 | 8/1972 | Aldrich et al. | 260/29.6 NR |
| 3,743,570 | 7/1973 | Yang et al. | 162/157 R |
| 3,816,556 | 6/1974 | Coscia et al. | 260/836 |
| 3,914,354 | 10/1975 | Ueki et al. | 162/157 R |

FOREIGN PATENT DOCUMENTS 2413922 10/1974 Fed. Rep. of Germany.

*Primary Examiner*—S. Leon Bashore
*Assistant Examiner*—Peter Chin
*Attorney, Agent, or Firm*—John W. Whitson

[57] ABSTRACT

Hydrophilic polyolefin fibers may be prepared, for example, by discharging a heated and pressurized solution of an anionic polyolefin composition containing carboxylic functionality into a zone of reduced temperature and pressure, and then modifying the fibers so produced by treatment with an aqueous admixture of selected cationic and anionic water-soluble, nitrogen-containing polymers. Blends of the hydrophilic fibers with wood pulp provide paper products having improved physical properties.

14 Claims, No Drawings

PREPARATION OF HYDROPHILIC POLYOLEFIN FIBERS FOR USE IN PAPERMAKING

This invention relates to a process for the preparation of hydrophilic polyolefin fibers which are readily dispersible in water and which can be blended with wood pulp fibers to provide a pulp which can be made into high quality paper using conventional papermaking techniques. More particularly, the invention relates to the formation of polyolefin-based fibers containing carboxylic functionality and treatment of these fibers with blends of certain water-soluble, nitrogen-containing polymers, one of which is cationic and the other of which is anionic.

In recent years, a considerable amount of effort has been expended in the development of fibrous polyolefin pulps having hydrophilic properties. One procedure developed for the purpose of attaining such hydrophilic properties is that described in U.S. Pat. No. 3,743,570 to Yang et al, assigned to Crown Zellerbach Corporation. According to this patent, polyolefin fibers having a high surface area are treated with a hydrophilic colloidal polymeric additive composed of a cationic polymer such as melamine-formaldehyde and an anionic polymer such as carboxymethyl cellulose. Another procedure developed for the preparation of hydrophilic polyolefin pulps has been one involving the spurting of a mixture of the polyolefin and an additive such as a hydrophilic clay or a hydrophilic polymer, for example, polyvinyl alcohol. The spurting process used in these preparations is one in which the polyolefin and the hydrophilic additive are dispersed in a liquid which is not a solvent for either component at its normal boiling point, heating the resulting dispersion at superatmospheric pressure to dissolve the polymer and any solvent-soluble additive, and then discharging the resulting composition into a zone of reduced temperature and pressure, usually atmospheric, to form the fibrous product.

A significant deficiency of these hydrophilic polyolefin pulps has been that, when they have been blended with wood pulp, the resulting paper products have exhibited considerably less strength than that of a paper prepared from wood pulp alone. However, some improvement in the strength of paper made from blends of polyolefin pulps and wood pulp has been realized by imparting an anionic character to the polyolefin pulp. For example, in their German application No. 413,922, filed Mar. 22, 1974 and published Oct. 17, 1974 as No. 2,413,922, Toray Industries, Inc. have disclosed the preparation of anionic pulps by spurting mixtures of polyolefins and copolymers of olefinic compounds with maleic anhydride or acrylic or methacrylic acids. Blends of these pulps with wood pulp have provided paper with better tensile strength than paper made without the copolymer component.

Now in accordance with this invention, it has been found that paper having further improved dry-strength properties can be prepared by forming a spurted fibrous anionic polyolefin composition containing carboxylic functionality, for example, a spurted fibrous composition comprising a mixture of a polyolefin and a carboxyl-containing anionic polymer, and then modifying this fibrous product by stirring a suspension of the fibers in a dilute aqueous solution or dispersion of a blend of a certain type of cationic, water-soluble, nitrogen-containing polymer and a certain type of anionic, water-soluble, nitrogen-containing polymer. The fiber modifying step of the process of this invention results in deposition of the blend of cationic and anionic nitrogen-containing polymers on the spurted fibers, and the originally anionic fibers are converted into modified fibers which are capable of bonding to the cellulosic fibers of wood pulp. It is a significant feature of the process of this invention that the cationic nitrogen-containing polymer used in the fiber-modifying step of the process is one which imparts no substantial amount of wet strength to the paper product and thus permits the reworking of broke to take place readily.

As an example of the process of this invention, polypropylene and an ethylene-acrylic acid copolymer are dispersed in a solvent such as methylene chloride, and the dispersion is heated in a closed system to a temperature of about 190° C. to dissolve the polymer components in the solvent. Under these conditions, the pressure generated by the methylene chloride vapors is of the order of 600 p.s.i. After introducing nitrogen to increase the vapor pressure of the system to a pressure of about 1000 p.s.i., the resulting solution is vented to the atmosphere through an orifice, resulting in evaporation of the methylene chloride solvent and formation of the fiber product. The fiber product then is suspended in an aqueous medium formed by blending a dilute aqueous solution of, for example, the reaction product of ammonia with epichlorohydrin-modified poly(diethylenetriamineadipic acid) with a dilute aqueous solution of, for example, glyoxal-modified poly(acrylamide-co-acrylic acid), and the components of the resulting suspension are brought into intimate contact with each other by stirring. The treated fibers may then be isolated and stored in wet cake form, or the suspension containing the fibers may be used directly in a papermaking process.

Having generally outlined the embodiments of this invention, the following examples constitute specific illustrations thereof. All amounts are based on parts by weight.

EXAMPLE A

A cationic, water-soluble, nitrogen-containing polymer was prepared from diethylenetriamine, adipic acid, epichlorohydrin and ammonia. Diethylenetriamine in the amount of 0.97 mole was added to a reaction vessel equipped with a mechanical stirrer, a thermometer and a reflux condenser. There then was gradually added to the reaction vessel one mole of adipic acid with stirring. After the acid had dissolved in the amine, the reaction mixture was heated to 170°–175° C. and held at that temperature for one and one-half hours, at which time the reaction mixture had become very viscous. The reaction mixture then was cooled to 140° C., and sufficient water was added to provide the resulting polyamide solution with a solids content of about 50%. A sample of the polyamide isolated from this solution was found to have a reduced specific viscosity of 0.155 deciliters per gram when measured at a concentration of two percent in a one molar aqueous solution of ammonium chloride.

The polyamide solution was diluted to 13.5% solids and heated to 40° C., and epichlorohydrin was slowly added in an amount corresponding to 1.32 moles per mole of secondary amine in the polyamide. The reaction mixture then was heated at a temperature between 70° and 75° C. until it attained a Gardner viscosity of E–F. Sufficient water next was added to provide a solids content of about 12.5%, and the solution was cooled to 25° C. The pH of the solution then was adjusted to 4.7 with concentrated sulfuric acid. The resulting solution contained 12.5% solids and had a Gardner viscosity of B–C, and 80 parts of this solution was diluted to 10% solids with 20 parts of water. After adding sufficient sodium hydroxide to adjust the pH of the solution to 7, the solution was combined with 18.7 parts of concentrated (28%) aqueous ammonia and heated under reflux at 80°–85° C. for two hours. The resulting solution contained 10.1% solids.

EXAMPLE B

Another representative cationic, water-soluble, nitrogen-containing polymer was prepared, this time using diethylenetriamine, dicyandiamide and epichlorohydrin as the reactants. Diethylenetriamine in the amount of 206.4 parts was added to a reaction vessel equipped with a mechanical stirrer, a thermometer and a reflux condenser. There then was gradually added to the reaction vessel 165 parts of dicyandiamide with stirring. The reaction mixture was slowly heated to 130° C., at which point ammonia was vigorously evolved and the temperature of the reaction mixture exothermically rose to 160° C. After holding the temperature at 160° C. for three hours, the reaction mixture was cooled and diluted by the addition of sufficient water to provide the resulting suspension of the condensate product with a solids content of 58.8%.

Eighty-five parts of the above suspension was diluted with water to a solids content of 25% and added to a reaction vessel equipped with a mechanical stirrer, a thermometer and a reflux condenser. After heating the mixture to 60° C., with stirring, 35.5 parts of epichlorohydrin was slowly added to the reaction vessel, maintaining the temperature at 60° C. The reaction mixture was maintained at about 60° C. until a Gardner-Holdt viscosity of N was reached, at which point 200 parts of water was added to terminate the reaction. After adjusting the pH of the solution to 5 by the addition of formic acid, the solids content was 19.4%.

EXAMPLE C

Another representative cationic, water-soluble, nitrogen-containing polymer was prepared from methacryloyloxyethyltrimethylammonium methylsulfate. Twenty parts of this ammonium compound was dissolved in 175 parts of water, and to the resulting solution was added 0.04 part of copper sulfate. The solution was heated to 70° C. while being sparged with nitrogen. At this point, there was added to the solution 0.2 parts of ammonium persulfate dissolved in 4.4 parts of water, and heating of the solution was continued for one hour. The resulting solution of poly(methacryloyloxyethyltrimethylammonium methylsulfate) contained 20% solids and had a Brookfield viscosity of 72 centipoises at 21° C.

EXAMPLE D

An anionic, water-soluble, nitrogen-containing polymer was prepared from acrylamide, acrylic acid and glyoxal. To a reaction vessel equipped with a mechanical stirrer, a thermometer, a reflux condenser and a nitrogen adapter was added 890 parts of water. There then was dissolved in the water 98 parts of acrylamide, two parts of acrylic acid and one and one-half parts of aqueous 10% cupric sulfate. The resulting solution was sparged with nitrogen and heated to 76° C., at which point two parts of ammonium persulfate dissolved in six and one-half parts of water was added. The temperature of the reaction mixture increases 21.5° C. over a period of three minutes following addition of the persulfate. When the temperature returned to 76° C., it was maintained there for two hours, after which the reaction mixture was cooled to room temperature. The resulting solution had a Brookfield viscosity of 54 centipoises at 21° C. and contained less than 0.2% acrylamide based on the polymer content.

To 766.9 parts of the above solution (76.7 parts of polymer containing 75.2 parts, or 1.06 mole, of amide repeat units) was added 39.1 parts of aqueous 40% glyoxal (15.64 parts, or 0.255 equivalent based on amide repeat units, of glyoxal). The pH of the resulting solution was adjusted to 9.25 by the addition of 111.3 parts of aqueous 2% sodium hydroxide. Within approximately 20 minutes after addition of the sodium hydroxide, the Gardner viscosity of the solution had increased from A to E. The reaction was then terminated by the addition of 2777 parts of water and about two and six-tenths parts of aqueous 40% sulfuric acid. The resulting solution had a pH of 4.4 and contained 2.2% solids.

EXAMPLE E

Another representative anionic, water-soluble, nitrogen-containing polymer was prepared using only acrylamide and glyoxal as reactants. In a reaction vessel equipped with a stirrer, a thermometer and a reflux condenser, there was placed 350 parts of acrylamide, one part of phenyl-β-naphthylamine and 3870 parts of chlorobenzene. This mixture was heated to 80° to 90° C. with vigorous stirring to partially melt and partially dissolve the acrylamide. One part of sodium hydroxide flake then was added to the mixture and, after an induction period, an exothermic reaction occurred and there was separation of polymer on the stirrer and on the walls of the reaction vessel. Three more one-part charges of sodium hydroxide flake were added to the reaction mixture at thirty-minute intervals, following which the reaction mixture was heated at about 90° C. for one hour. The hot chlorobenzene then was decanted, and the residual solid, a branched, water-soluble poly(β-alanine), was washed three times with acetone and subsequently dissolved at room temperature in 1000 parts of water. The cloudy solution so obtained, having a pH of about 10.5, was heated at about 75° C. for about 30 minutes to effect partial hydrolysis of the amide groups in the poly(β-alanine), and live steam was blown through the solution until the residual chlorobenzene had been removed and the last traces of polymer had dissolved. After cooling, the solution was adjusted to a pH of about 5.5 with sulfuric acid. The dissolved polymer contained about two mole percent carboxyl groups, as determined by potentiometric titration.

To an aqueous 15% solution of the above polymer was added an aqueous 40% solution of glyoxal in an amount sufficient to provide 25 mole percent of glyoxal based on the amide repeat units in the polymer. The pH of the resulting solution was slowly raised to about 9.0 to 9.5 at room temperature by the addition of dilute aqueous sodium hydroxide, and the pH was maintained at this level until an increase in Gardner viscosity of five to six units had occurred. The solution then was quickly diluted with water to 10% total solids and adjusted to a pH of 5.0 with sulfuric acid.

EXAMPLE 1

One hundred eighty parts of isotactic polypropylene having an intrinsic viscosity of 2.7 in decahydronaphthalene at 135° C. and 1020 parts of pentane were charged to a closed autoclave. The contents of the autoclave were stirred and heated to 160° C., at which point the vapor pressure in the autoclave was raised to 850 p.s.i. by the introduction of nitrogen. The resulting solution was spurted from the autoclave into the atmosphere through an orifice having a diameter of one millimeter and a length of one millimeter, resulting in evaporation of the pentane solvent and formation of the desired fiber product.

The spurted fiber product was blended with six percent by weight, based on the polypropylene fibers, of bleached kraft wood pulp (50:50 RBK:WBK, 500 Canadian Standard Freeness), and the fiber blend was disc refined until it became water-dispersible. One hundred ten parts of the fiber blend was suspended in 7090 parts of water, the resulting suspension was agitated, and a gas mixture containing three percent ozone in oxygen was passed through the suspension at room temperature at a rate of three and one-half cubic feet per minute for five hours. The ozonized pulp fibers had an acid number corresponding to 0.06 milliequivalent of carboxyl groups per gram of fiber.

Thirty parts of the ozonized pulp was blended with 70 parts of bleached kraft wood pulp, and to portions of the resulting blend in papermaking crocks was added five percent, based on the refined pulp content of the blend, of (a) a blend of Kymene® 557 (cationic polymer formed by reaction of epichlorohydrin with the aminopolyamide derived from adipic acid and diethylenetriamine) with an anionic polymer prepared according to Example D, the ratio of cationic:anionic being 1:5 by weight, (b) a blend of a cationic polymer prepared according to Example A with an anionic polymer prepared according to Example D, the cationic:anionic ratio being 1:5 by weight, (c) a blend of a cationic polymer prepared according to Example B with an anionic polymer prepared according to Example D, the cationic:anionic ratio being 1:5 by weight, and (d) a blend of a cationic polymer prepared according to Example C with an anionic polymer prepared according to Example D, the ratio of cationic:anionic being 1:5 by weight.

After thorough mixing of the additives with the pulp, handsheets were prepared, dried and calendered at 500 lbs./linear inch at 60° C. The opacity, brightness and Mullen burst strength of the calendered sheets were determined, and the results are given in Table 1. In the data given in this table, the Mullen burst strength values are expressed as a percentage of the Mullen burst strength of the 100% wood pulp control, all being corrected to a 40 pound per ream basis weight.

Table 1

| Additive | Brightness | Opacity | Mullen Burst Strength |
|---|---|---|---|
| | (%) | (%) | (%) |
| (a) | 87.8 | 84.5 | 74 |
| (b) | 87.1 | 84.7 | 70 |
| (c) | 87.5 | 84.3 | 75 |
| (d) | 88.0 | 84.0 | 74 |

Broke reworking studies made at a pH of 10 and a temperature of 150° F. showed that the papers made using additives (b), (c) and (d) were completely repulped after 10, 5 and 5 minutes, respectively, whereas the paper using additive (a) required 20 minutes for complete repulping. These studies were carried out in a standard TAPPI disintegrator, as described in TAPPI Method T 205 os-71, operating at 2800 r.p.m. and using one-inch squares of paper at a consistency of 1.33%.

EXAMPLE 2

The procedure of Example 1 was followed using as the additives (a) a blend of Kymene® 557 with an anionic polymer prepared according to Example E, the ratio of cationic:anionic being 1:3 by weight, and (b) a blend of a cationic polymer prepared according to Example B with an anionic polymer prepared according to Example E, the ratio of cationic:anionic being 1:3 by weight. The data obtained from evaluating the resulting handsheets are given in Table 2.

Table 2

| Additive | Brightness | Opacity | Mullen Burst Strength |
|---|---|---|---|
| | (%) | (%) | (%) |
| (a) | 89.0 | 85.0 | 77 |
| (b) | 88.5 | 84.5 | 74 |

Broke reworkability studies carried out as in Example 1 showed that the paper made using additive (b) was completely repulped after 10 minutes, whereas the paper made using additive (a) required 30 minutes for complete repulping.

EXAMPLE 3

The procedure of Example 1 was repeated except for use of 1:3 by weight ratios of cationic:anionic polymers in the the blends. The results obtained are shown in Table 3.

Table 3

| Additive | Mullen Burst Strength | Reworkability (minutes) | |
|---|---|---|---|
| | | Adequate | Complete |
| | (%) | | |
| (a) | 76 | 10 | 40 |
| (b) | 74 | 5 | 10 |
| (c) | 76 | 5 | 10 |
| (d) | 71 | — | 5 |

The brightness and opacity of the handsheets were essentially the same as those of Example 1.

EXAMPLE 4

The procedure of Example 1 was repeated except for use of 1:1 ratios by weight of cationic:anionic polymers in the blends. The results obtained are shown in Table 4.

Table 4

| Additive | Mullen Burst Strength | Reworkability (minutes) | |
|---|---|---|---|
| | | Adequate | Complete |
| | (%) | | |
| (a) | 87 | 30 | 60 |
| (b) | 81 | 10 | 20 |
| (c) | 80 | 5 | 20 |
| (d) | 72 | 5 | 20 |

The brightness and opacity of the handsheets were substantially the same as those of Example 1.

Results comparable to those shown in Examples 1 to 4 were obtained when the ozonized pulp fibers of Example 1 were replaced with spurted fibrous anionic polyolefin compositions containing carboxylic functionality prepared in accordance with the following examples.

EXAMPLE 5

Ninety parts of isotactic polypropylene having an intrinsic viscosity of 2.1 in decahydronaphthalene at 135° C. and 10 parts of an ethylene-acrylic acid copolymer (Dow, 92:8 ethylene:acrylic acid, melt index 5.3) were charged to a closed autoclave along with 400 parts of methylene chloride as the solvent. The contents of the autoclave were stirred and heated to 220° C., at which point the vapor pressure in the autoclave was raised to 1000 p.s.i. by the introduction of nitrogen. The resulting solution was spurted from the autoclave into the atmosphere through an orifice having a diameter of one millimeter and a length of one millimeter, resulting in evaporation of the methylene chloride solvent and formation of the desired fiber product. This fiber product then was disc refined for six minutes in a Sprout Waldron disc refiner at 1.5% consistency in water.

EXAMPLE 6

The procedure of Example 5 was followed using 200 parts of crystalline polypropylene grafted with three percent by weight of maleic anhydride, 2672 parts of methylene chloride, a temperature of 200° C. and a pressure of 1000 p.s.i. The spurted fiber product was disc refined as in Example 5.

EXAMPLE 7

The procedure of Example 5 was used to prepare a spurted fiber product from crystalline polypropylene grafted with six percent by weight of acrylic acid. A 3:2 by weight ratio of water:hexane was used as the dispersing medium. The fiber product was disc refined as in Example 5.

EXAMPLE 8

Ninety parts of high density polyethylene (DuPont, melt index 5.5–6.5 at 190° C.) was substituted for the polypropylene in Example 5 and the admixture with the ethylene-acrylic acid copolymer was spurted from solution in methylene chloride at 200° C. and 1000 p.s.i. pressure. The fiber product was disc refined as in Example 5.

EXAMPLE 9

Eighty parts of the polypropylene of Example 5 and 20 parts of a styrene-maleic anhydride copolymer (Arco, 75:25 styrene:maleic anhydride, molecular weight 19,000) were charged to a closed autoclave along with 250 parts of hexane and 250 parts of water. The contents of the autoclave were stirred and heated to 220° C., at which point the vapor pressure in the autoclave was raised to 1000 p.s.i. with nitrogen. The resulting emulsion was spurted from the autoclave into the atomsphere through an orifice having a diameter of one millimeter and a length of one millimeter, resulting in formation of a fiber product. The fiber product was disc refined as in Example 5.

In the process of this invention, the anionic polyolefin composition containing carboxylic functionality may be a polyolefin containing carboxyl groups which have been introduced into the polymer molecule by grafting the polyolefin with a monomer-containing carboxylic functionality or by oxidizing the polyolefin with oxygen or ozone, or the composition may be a polyolefin in admixture with an anionic polymer containing carboxylic functionality. In any case, the polyolefin may be polyethylene, polypropylene, an ethylene-propylene copolymer or a mixture of any of these polyolefin materials.

When the anionic polyolefin composition is an admixture of a polyolefin and an anionic polymer containing carboxylic functionality, the latter component may be a polyolefin containing carboxyl groups directly attached to the polymer backbone, a polyolefin grafted with acrylic acid, methacrylic acid, maleic anhydride or mixtures thereof, a copolymer of any one of ethylene, propylene, styrene, α-methylstyrene or mixtures thereof with any one of acrylic acid, methacrylic acid, maleic anhydride or mixtures thereof, as well as mixtures of any of these anionic polymer components. Again, wherever specified, the polyolefin may be polyethylene, polypropylene, an ethylene-propylene copolymer or mixtures thereof.

In the foregoing admixtures of polyolefin and anionic polymer containing carboxylic functionality, the ratio of the former to the latter will preferably be from about 95:5 to about 80:20 by weight, and the amount of available carboxyl in the anionic polymer will be from about three to about 30% by weight. In general, the anionic polyolefin composition used in the process of this invention should contain a sufficient amount of carboxylic functionality to provide at least 0.01, and preferably at least about 0.04 milliequivalent of carboxyl groups per gram of the polyolefin pulp. Moreover, the amount of carboxylic functionality may be such as to provide up to about one milliequivalent of carboxyl groups per gram of the polyolefin pulp. A highly desirable range is from about 0.04 to about 0.2 milliequivalent per gram.

The dispersing medium used in the fiber-forming step of the process of this invention contains an organic solvent which is a nonsolvent at its normal boiling point for the polyolefin composition used to form the fibers. It may be the methylene chloride shown in some of the examples, or other halogenated hydrocarbons such as chloroform, carbon tetrachloride, methyl chloride, ethyl chloride, trichlorofluoromethane and 1,1,2-trichloro-1,2,2-trifluoroethane. Also useful are aromatic hydrocarbons such as benzene, toluene and xylene; aliphatic hydrocarbons such as butane, pentane, hexane, heptane, octane and their isomers; and alicyclic hydrocarbons such as cyclohexane. Mixtures of these solvents may be used, and water may be present when it is desired to form an emulsion of the polyolefin composition. Moreover, the pressure generated by the solvent vapors may be, and normally will be, augmented by a pressurized inert gas such as nitrogen or carbon dioxide.

In carrying out the fiber-forming process, the concentration of the polyolefin composition in solution in the solvent normally will be from about 5 to about 40% by weight, preferably from about 10 to about 20% by weight. The temperature to which the dispersion of the polyolefin composition in the solvent is heated to form a solution of the composition will be dependent upon the particular solvent used and should be sufficiently high to effect dissolution of the composition. The fiber-forming temperature will generally be in the range of from about 100° to about 225° C. The pressure on the solution of the polyolefin composition may be from about 600 to about 1500 p.s.i., but preferably is in the range of from about 900 to about 1200 p.s.i. The orifice through which the solution is discharged should have a diameter of from about 0.5 to about 15 mm., preferably from about one to about five mm., and the ratio of the length of the orifice to its diameter should be from about 0.2 to about 10.

In the fiber-modifying step of the process of this invention, the fibers of the fibrous anionic polyolefin composition containing carboxylic functionality are suspended in a dilute aqueous admixture of certain cationic and anionic nitrogen-containing polymers and the suspension is stirred, resulting in the deposition on the fibers of from about one to about 15% by weight of the admixture, based on the weight of the fibrous composition. The ratio of the cationic to the anionic polymer in the admixture of these polymers preferably is in the range of from about 3:1 to about 1:5 by weight, more preferably from about 1:1 to about 1:3 by weight. A preferred type of cationic polymer component of the aforementioned admixture is one which is derived from a polymer containing secondary or tertiary amine groups, or both. One representative group of polymers belonging to this type may be exemplified by a cationic polymer component used in many of the examples, namely, the reaction product of ammonia with the epichlorohydrin-modified aminopolyamide derived from diethylenetriamine and adipic acid. Preparation of this product is shown in Example A. However, more generally, this group of cationic polymers are the reaction products of ammonia or lower alkyl amines with epichlorohydrin-modified aminopolyamides derived from a dicarboxylic acid and a polyalkylenepolyamine having two primary amine groups and at least one secondary or tertiary amine group.

Particularly suitable dicarboxylic acids for preparation of the aminopolyamides are diglycolic acid and saturated aliphatic dicarboxylic acids containing from 3 through 10 carbon atoms such as malonic acid,, succinic acid, glutaric acid, adipic acid, pimelic acid, suberic acid, azelaic acid, and sebacic acid. Other suitable dicarboxylic acids include terephthalic acid, isophthalic acid, phthalic acid, maleic acid, fumaric acid, itaconic acid, glutaconic acid, citraconic acid, and mesaconic acid. The available anhydrides of the above acids can be used in preparing the water-soluble aminopolyamide as well as the esters of the acids. Mixtures of two or more dicarboxylic acids, their anhydrides, and their esters can be used to prepare the water-soluble aminopolyamides, if desired.

A number of polyalkylene polyamines, including polyethylene polyamines, polypropylene polyamines, polybutylene polyamines and the like can be employed in preparation of the aminopolyamides. Polyalkylene polyamines can be represented as polyamines in which the nitrogen atoms are linked together by groups of the formula $-C_nH_{2n}-$ where n is a small integer greater than unity and the number of such groups in the molecule ranges from two up to about eight. The nitrogen atoms can be attached to adjacent carbon atoms in the group $-C_nH_{2n}-$ or to carbon atoms farther apart, but not to the same carbon atom. Polyamines such as diethylenetriamine, triethylenetetramine, tetraethylenepentamine, and dipropylenetriamine, which can be obtained in reasonably pure form are suitable for preparing water-soluble aminopolyamides. Other polyalkylene polyamines that can be used include methyl bis-(3-aminopropyl)amine; methyl bis-(2-aminoethyl)amine; and 4,7-dimethyltriethylenetetramine. Mixtures of polyalkylene polyamines can be used, if desired.

The spacing of an amino group on the aminopolyamide can be increased if desired. This can be accomplished by substituting a diamine such as ethylenediamine, propylenediamine, hexamethylenediamine and the like for a portion of the polyalkylene polyamine. For this purpose, up to about 80% of the polyalkylene polyamine can be replaced by a molecularly equivalent amount of diamine. Usually, a replacement of about 50% or less will be adequate.

The temperatures employed for carrying out the reaction between the dicarboxylic acid and the polyalkylenepolyamine may vary from about 110° C. to about 250° C. or higher at atmospheric pressure. For most purposes, however, temperatures between about 160° C. and 210° C. have been found satisfactory and are preferred. Where reduced pressures are employed, somewhat lower temperatures may be utilized. The time of reaction depends on the temperatures and pressures utilized and will ordinarily vary from about one-half to two hours, although shorter or longer reaction times may be utilized depending on reaction conditions. In any event, the reaction is desirably continued to substantial completion for best results.

In carrying out the reaction, it is preferred to use an amount of dicarboxylic acid sufficient to react substantially completely with the primary amine groups of the polyalkylene polyamine but insufficient to react with the secondary and/or tertiary amine groups to any substantial extent. This will usually require a mole ratio of polyalkylenepolyamine to dicarboxylic acid of from about 0.9:1 to about 1.2:1. However, mole ratios of from about 0.8:1 to about 1.4:1 may be used with quite satisfactory results. Mole ratios outside of these ranges are generally unsatisfactory. Thus, mole ratios below about 0.8:1 result in a gelled product or one having a pronounced tendency to gel while mole ratios above 1.4:1 result in low molecular weight polyamides.

In converting the aminopolyamide, formed as above described, to a cationic resin, it is reacted with epichlorohydrin at a temperature from about 45° C. to about 100° C. and preferably between about 45° C. and 70° C. until the viscosity of a 20% solids solution at 25° C. has reached about C or higher on the Gardner scale. This reaction is preferably carried out in aqueous solution to moderate the reaction. pH adjustment is usually not necessary. However, since the pH decreases during the polymerization phase of the reaction, it may be desirable, in some cases, to add alkali to combine with at least some of the acid formed.

When the desired viscosity is reached, sufficient water is then added to adjust the solids content of the resin solution to the desired amount, i.e., about 10% more or less, the product cooled to about 25° C. and the product then may be stabilized by adding sufficient acid to reduce the pH at least to about 6 and preferably to about 5. Any suitable acid such as hydrochloric, sulfuric, nitric, formic, phosphoric and acetic acid may be used to stabilize the product. However, sulfuric acid is preferred.

In the aminopolyamide-epichlorohydrin reaction, it is preferred to use sufficient epichlorohydrin to convert all secondary amine groups to tertiary amine groups. However, more or less may be added to moderate or increase reaction rates. In general, satisfactory results may be obtained utilizing from about 0.5 mole to about 1.8 moles of epichlorohydrin for each secondary or teriary amine group of the aminopolyamide. It is preferred to utilize from about 1.0 mole to about 1.5 moles for each secondary amine group of the aminopolyamide.

The reaction of ammonia or a lower alkyl amine with the epichlorohydrin-modified aminopolyamide to produce a cationic polymer component useful in accordance with this invention preferably is carried out in an aqueous medium, which can be the same as that containing the epichlorohydrin-modified aminopolyamide. However, since the reaction with ammonia or the amine requires a pH of 7 or above, it may be necessary first of all to adjust the pH of the polymer solution, desirably by adding an alkali metal hydroxide such as sodium hydroxide. Moreover, for the reaction with ammonia or the amine, the solids content of the polymer solution should be in the range of from about one to about 25% by weight, preferably from about six to about 15%. The reaction is carried out at a temperature in the range of from about 0° to about 150° C., preferably from about 50° to about 100° C. Pressures greater than atmospheric may be used, if desired, particularly at temperatures above the boiling point of the reaction mixture.

The lower alkyl amines useful in the above reaction may be any primary, secondary or tertiary alkyl amine containing one to four carbon atoms in each of the alkyl radicals. Representative of such amines are methylamine, dimethylamine, trimethylamine and the corresponding ethyl-, propyl-, isopropyl-, butyl- and isobutyl-amines, as well as t-butylamine and di-t-butylamine. Also useful are the amines containing different $C_1$–$C_4$ alkyl groups in the molecule, for example, N-ethyl-N-methylpropylamine, N,N-dimethylethylamine, N,N-diethylpropylamine, N-ethyl-N-propyl-t-butylamine, N-methylpropylamine and N-ethylbutylamine.

The amount of ammonia or lower alkyl amine used in the reaction with the epichlorohydrin-modified aminopolyamide should be at least stoichiometrically equivalent to the amount of epoxide groups introduced into the aminopolyamide in its reaction with epichlorohydrin. Complete reaction with all of the epoxide groups is necessary to avoid gelation, consequently, it is desirable to use a substantial excess of ammonia or the amine. Any unreacted ammonia or amine can be permitted to remain in the reaction product or can be removed, as by heating under atmospheric or reduced pressure, and recovered for further use.

Another representative group of polymers belonging to the preferred type of cationic polymers is that wherein the polymers are the water-soluble reaction products of epichlorohydrin and the condensates of a polyalkylene polyamine with cyanamide or dicyandiamide. The preparation of an exemplary product from this group is shown in Example B. The polyalkylene polyamines which can be reacted with cyanamide or dicyandiamide have the formula $H_2N(C_nH_{2n}NH)_xH$ wherein n is an integer 2 through 8 and x is an integer 2 or more, preferably 2 through 6. Examples of such polyalkylene polyamines are the polyethylene polyamines, polypropylene polyamines and polybutylene polyamines. Specific examples of these polyalkylene polyamines include diethylenetriamine, triethylenetetramine, tetraethylenepentamine, bis(hexamethylene)triamine and dipropylenetriamine. Other polyalkylene polyamines that can be used include methyl bis(3-aminopropyl)amine; methyl bis(2-aminoethyl)amine; and 4,7-dimethyltriethylenetetramine. Mixtures of polyalkylene polyamines can be used if desired. The relative proportions of polyalkylene polyamine and cyanamide or dicyandiamide will vary depending upon the particular polyalkylene polyamine used. In general, however, there is used from about 0.1 to about 1.0 mole of dicyandiamide for every equivalent of primary amine groups in the polyalkylene polyamine. For example, diethylenetriamine will require from about 0.2 to about 2.0 moles of dicyandiamide. In any given case, the amount of cyanamide, when used, will be twice the amount of dicyandiamide.

The condensation of the polyalkylene polyamine with cyanamide or dicyandiamide is carried out by heating the reactants at a temperature in the range of from about 100° to about 200° C., preferably from about 130° to about 160° C. Generally, it is not necessary to use a solvent, but if one is desired, the mono- or di-alkyl ethers of ethylene glycol or diethyleneglycol are suitable. During the reaction, ammonia is evolved. Upon completion of the reaction, the reaction mixture is diluted with water to a solids content of, for example, about 25%, and the resulting product is suitable for reaction with epichlorohydrin to provide a water-soluble, cationic polymer useful in accordance with this invention. The reaction with epichlorohydrin generally is carried out under conditions similar to those already described for preparation of the epichlorohydrin-modified aminopolyamides.

Another group of preferred cationic polymers useful in accordance with this invention is that in which the polymers are poly(diallyldialkylammonium chloride)s. These are linear polymers having units of the formula:

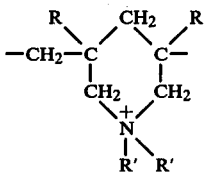

where R is hydrogen or lower alkyl and R′ is alkyl or a substituted alkyl group. Polymers having units of the above formula are obtained by polymerizing quaternary ammonium chloride salt monomers in which the quaternary ammonium cation is represented by the formula:

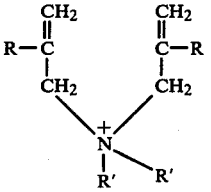

in which R and R′ are as indicated above, in the presence of a free radical catalyst.

In both of the above formulae, each R can be the same or different, and, as stated, can be hydrogen or lower alkyl. The alkyl groups may contain from 1 to 4 carbons and are preferably methyl, ethyl, isopropyl or n-butyl. R′ of the formulae represents alkyl or substituted alkyl groups. The R′ alkyl groups may contain from 1 to 18 carbon atoms, preferably from 1 to 6 carbon atoms, such as methyl, ethyl, propyl, isopropyl, butyl, tert-butyl, hexyl, octyl, decyl, dodecyl, tetradecyl, and octadecyl. R′ may also be a substituted alkyl group. Suitable substituents include, in general, any group which will not interfere with polymerization through a vinyl double bond. Typically, the substituents may be carboxylate, cyano, ether or amido.

The monomers used in preparing the above polymers can themselves be prepared, for example, by the reaction of a primary amine with an allyl halide to produce the corresponding tertiary amine, followed by quaternization of the latter with an alkyl chloride. Thus, for example, diallyldimethylammonium chloride can be prepared by reaction of two moles of an allyl halide, such as allyl chloride, with one mole of methylamine to form N-methyldiallylamine hydrochloride, which then is quaternized with methyl chloride.

In preparing the diallyldialkylammonium chloride polymers, the polymerization reaction can be initiated by a redox catalyst system. In a redox system, the catalyst is activated by means of a reducing agent such as sodium metabisulfite or potassium metabisulfite, or by means of a reducing salt such as ferrous sulfate. The use of a redox initiator system has several advantages, the most important of which is efficient polymerization at lower temperatures. Conventional peroxide catalysts such as tertiary-butyl hydroperoxide, potassium persulfate, hydrogen peroxide and ammonium persulfate are used in conjunction with the above reducing agents. The polymerization generally is carried out in a solvent, preferably water, at a temperature of from about 0° to about 100° C., preferably from about 25° to about 75° C. Instead of water, solvents such as ethanol dioxane, dimethylformamide or acetonitrile also may be used. The concentration of the monomer in the solvent may be from about 10 to about 75%, preferably from about 25 to about 60%.

A final group of effective cationic polymers useful in accordance with this invention is that in which the polymers are homopolymers, or certain copolymers, of acrylate and methacrylate alkyl esters containing quaternary ammonium groups. The preparation of an exemplary product from this group of cationic polymers is shown in Example C. The alkylene group in these compounds preferably contains two to four carbon atoms, as in, for example, β-methacryloyloxyethyldimethylbenzylammonium chloride and acryloyloxy-n-butyldiethylmethylammonium methyl sulfate. Other representative monomers are acryloyloxyethyltrimethylammonium methyl sulfate, β-methacryloyloxyethyltrimethylammonium sulfate, β-methacryloyloxyethyldiethylmethylammonium methyl sulfate and β-methacryloyloxyethyldiethylmethylammonium chloride. These monomers all contain quaternary ammonium groups having three alkyl substituents, each of which contains one or two carbon atoms.

Any of the foregoing monomers may be copolymerized with an acrylamide having the formula

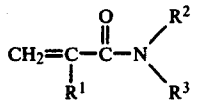

wherein $R^1$, $R^2$ and $R^3$ may each be hydrogen or a lower alkyl group having one to four carbon atoms. Representative compounds of the above formula are acrylamide, methacrylamide and N-isopropylacrylamide, with acrylamide being preferred. The acrylamide monomers may be used in amounts up to about 75 mole percent when copolymerized with the acrylate and methacrylate esters containing quaternary ammonium groups. Processes for carrying out the polymerizations here involved are well known in the art.

The polymers which are useful as the anionic polymer component of the aqueous solution or dispersion in which the fibers of the fibrous anionic polyolefin composition containing carboxylic functionality are modified also have been illustrated in the examples. One of these is the reaction product of glyoxal and the polyacrylamide obtained by copolymerization of acrylamide with acrylic acid. The preparation of an exemplary product is shown in Example D. The amount of acrylic acid units in the copolymer may be from about two to about 15%. Comparable products can be prepared by partial hydrolysis of polyacrylamide or a poly(acrylamide-co-alkyl acrylate) such as a copolymer of acrylamide with ethyl acrylate. Any of these polyacrylamides can be prepared by conventional methods for the polymerization of water-soluble monomers and preferably have molecular weights less than about 25,000, for example, in the range of from about 10,000 to about 20,000.

The other anionic, nitrogen-containing polymer shown in the examples is the reaction product of glyoxal and the polymer obtained by partial hydrolysis of a branched, water-soluble poly(β-alanine). Preparation of a representative product is shown in Example E. The poly(β-alanine) is prepared by the anionic polymerization of acrylamide in the presence of a basic catalyst and a vinyl or free-radical polymerization inhibitor, and the polymer will have a molecular weight in the range of from about 500 to about 10,000, preferably from about 2000 to about 6000. Because of the extremely exothermic nature of the anionic polymerization, it is preferred to conduct the reaction in a suitable organic reaction medium inert to the reaction conditions and capable of dissolving or slurrying acrylamide. Suitable media include aromatic and aliphatic compounds, for example, toluene, xylene, tetrahydronaphthalene, chlorobenzene, nitrobenzene and dioxane. The concentration of the acrylamide monomer in the reaction medium is in the range of from about two to about 30%, and is preferably from about eight to about 15%. If desired, an organosoluble polymeric dispersing agent can be added to the reaction mixture prior to the addition of the basic catalyst. When the dispersing agent is employed, the poly(β-alanine) produced is in powdered or bead form, easily filterable from the reaction medium. Suitable dispersing agents are styrene-butadiene copolymers, polyisoprene, chlorinated polypropylene, chlorinated and maleated polyisoprene and chlorinated and maleated polyolefins.

Illustrative basic catalysts which can be employed include alkali metals, alkali metal hydroxides, alkaline earth metal hydroxides, quaternary ammonium hydroxides and the alkali metal alkoxides. Specific examples of suitable basic catalysts are sodium, sodium hydroxide, lithium hydroxide, potassium hydroxide, sodium t-butoxide, sodium methoxide, tetramethylammonium hydroxide, potassium t-butoxide and calcium hydroxide. The amount of catalyst used is in the range of about 0.01 to about 2.0 mole %, preferably about 0.1 to about 1.5 mole %, based on the monomer. A free radical inhibitor is added to the reaction mixture to inhibit vinyl polymerization through the double bond of the acrylamide monomer. Examples of free radical inhibitors which can be used are phenyl-β-naphthylamine, hydroquinone, diphenylamine and phenothiazine. The polymerization reaction is conducted at temperatures in the range of from about 40° to about 140° C. and preferably from about 80° to about 130° C. In some cases, the anionic polymerization of acrylamide under the preceding conditions will produce a mixture of water-soluble and water-insoluble poly(β-alanine). The water-soluble polymer can be readily separated by partially dissolving the polymer product in water and removing the insoluble fraction by conventional methods such as filtration.

The branched poly(β-alanine) produced as described above is a neutral polymer and needs to be anionically modified for the purpose of this invention. Anionic modification of branched poly(β-alanine) can be accomplished by partial hydrolysis of the polymer to convert some of the primary amide groups into anionic carboxyl groups. For example, hydrolysis of poly(β-alanine) can take place by heating a slightly basic aqueous solution of the polymer having a pH of about 9 to 10 at temperatures of about 50° to about 100° C. The amount of anionic groups introduced should be from about one to about ten mole percent, and preferably about two to about five mole percent, based on amide repeating units.

Each of the anionic, nitrogen-containing polymers described above is modified with glyoxal to provide the desired anionic, water-soluble, nitrogen-containing polymers used in accordance with this invention. The reaction with glyoxal is carried out in a dilute neutral or slightly alkaline aqueous solution of the polymer at a temperature of from about 10° to about 50° C., preferably from about 20° to about 30° C. The concentration of the polymer in the solution may be from about five to about 40% by weight, but preferably is from about seven to about 20%. The amount of glyoxal used in the reaction mixture may be from about 10 to about 100 mole percent, preferably from about 20 to about 30 mole percent, based on amide repeat units in the polymer. The reaction is allowed to continue until a viscosity increase of from about two to about ten, preferably from about four to about six, units on the Gardner scale has taken place. This increase in viscosity is indicative that some crosslinking of the polymer has desirably taken place, but this amount of crosslinking is insufficient to cause gelation. The reaction then is terminated, usually by dilution of the reaction mixture with water and addition of sulfuric acid to lower the pH to about 4.5–5.0. The resulting solutions possess good stability.

The process of this invention makes possible the preparation of improved paper products from blends of wood pulp and polyolefin pulps. The process depends upon the particular combination of cationic and anionic nitrogen-containing polymers used in the fiber-modifying step, and the particular cationic polymers used provide the additional advantage of facile broke reworking. Moreover, the process depends upon several critical factors, namely, the presence of at least 80% polyolefin in the polyolefin-carboxyl-containing anionic polymer admixture, when this admixture constitutes the anionic polyolefin composition containing carboxylic functionality used as the fiber-forming material, an intrinsic viscosity of at least 1.0 for the polyolefin, sufficient available carboxyl in the anionic polyolefin composition containing carboxylic functionality and sufficient resin in the aqueous solution or dispersion in which the anionic fibers are modified. However, operation within the limits of these conditions makes it possible to produce a synthetic pulp which, when blended with wood pulp, will provide a paper product having at least 70% of the Mullen burst strength of 100% wood pulp, as well as improved brightness, opacity, smoothness and printability at low sheet weights compared with conventional filled or unfilled paper.

What I claim and desire to protect by Letters Patent is:

1. A process for the preparation of a fibrous pulp containing hydrophilic polyolefin fibers which comprises stirring a suspension of the fibers of a spurted fibrous polyolefin composition containing carboxylic functionality in a dilute aqueous admixture of water-soluble nitrogen-containing cationic and anionic polymers, said cationic polymer being (a) the reaction product of ammonia or a lower alkyl amine and an epichlorohydrin-modified aminopolyamide derived from a dicarboxylic acid and a polyalkylene polyamine having two primary amine groups and at least one secondary or tertiary amine group, or (b) the reaction product of epichlorohydrin and a condensate of cyanamide or dicyandiamide with a polyalkylene polyamine having the formula $H_2N(C_nH_{2n}NH)_xH$, wherein n is an integer 2 through 8 and x is an integer 2 or more, or (c) a poly(-diallyldialkylammonium chloride) or (d) a poly(acrylate or methacrylate alkyl ester containing quaternary ammonium groups), and said anionic polymer being the reaction product of glyoxal and (a) a polyacrylamide containing from about 2 to about 15% acrylic acid units or (b) a partially hydrolyzed, branched poly(β-alanine) containing from about 1 to about 10 mole percent carboxyl groups based on amide repeating units, the ratio of said cationic polymer to said anionic polymer in said admixture of polymers being in the range of from about 3:1 to about 1:5 by weight and the amount of said admixture of said polymers deposited on the fibers of said fibrous composition being from about one to about 15% by weight based on said fibrous composition.

2. The process of claim 1 wherein the spurted fibrous polyolefin composition containing carboxylic functionality is based on polyethylene.

3. The process of claim 1 wherein the spurted fibrous polyolefin composition containing carboxylic functionality is based on polypropylene.

4. The process of claim 3 wherein the spurted fibrous polyolefin composition containing carboxylic functionality is prepared by spurting a mixture of polypropylene and an anionic polymer containing carboxylic functionality.

5. The process of claim 4 wherein the anionic polymer containing carboxylic functionality is a copolymer of ethylene and acrylic acid.

6. The process of claim 3 wherein the spurted fibrous polyolefin composition containing carboxylic functionality is prepared by spurting polypropylene and oxidizing the resulting fibers to introduce carboxyl groups into the polypropylene molecule.

7. The process of claim 1 wherein the cationic, water-soluble, nitrogen-containing polymer is the reaction product of ammonia or a lower alkyl amine and an epichlorohydrin-modified aminopolyamide derived from a dicarboxylic acid and a polyalkylene polyamine having two primary amine groups and at least one secondary or tertiary amine group.

8. The processof claim 7 wherein the aminopolyamide is derived from adipic acid and diethylenetriamine.

9. The process of claim 8 wherein the anionic, water-soluble, nitrogen-containing polymer is the reaction product of glyoxal and the polyacrylamide obtained by copolymerization of acrylamide with acrylic acid.

10. The process of claim 8 wherein the anionic, water-soluble, nitrogen-containing polymer is the reaction product of glyoxal and the polymer obtained by partial hydrolysis of a branched, water-soluble poly(β-alanine).

11. The aqueous fibrous pulp suspension produced by the process of claim 1.

12. A paper product prepared from the aqueous fibrous pulp suspension fibers of claim 11.

13. The process of claim 1 wherein the hydrophilic polyolefin fibers are separated from said aqueous suspension thereof.

14. The hydrophilic polyolefin fibers produced by the process of claim 13.

* * * * *

UNITED STATES PATENT AND TRADEMARK OFFICE

CERTIFICATE OF CORRECTION

PATENT NO. : 4,154,647

DATED : May 15, 1979

INVENTOR(S) : Terence William Rave

It is certified that error appears in the above-identified patent and that said Letters Patent are hereby corrected as shown below:

Column 17, in Claim 12, line 2 thereof, delete "fibers".

Signed and Sealed this

*Twenty-fifth* Day of *September 1979*

[SEAL]

*Attest:*

*Attesting Officer*

LUTRELLE F. PARKER

*Acting Commissioner of Patents and Trademarks*